US005329950A

United States Patent [19]

Barinas

[11] Patent Number: 5,329,950

[45] Date of Patent: Jul. 19, 1994

[54] CLEAN-IN-PLACE PROCESS AND EQUIPMENT

[75] Inventor: Joseph P. Barinas, Hardwick Township, Warren County, N.J.

[73] Assignee: Sanirab Corporation, Blairstown, N.J.

[21] Appl. No.: 62,347

[22] Filed: May 14, 1993

[51] Int. Cl.[5] ..... B08B 3/02

[52] U.S. Cl. ..... 134/95.3; 134/98.1; 134/102.1; 134/103.1; 134/103.2

[58] Field of Search ..... 134/95.1, 95.3, 98.1, 134/102.1, 103.1, 103.2, 169 R

[56] References Cited

U.S. PATENT DOCUMENTS

| | | | |
|---|---|---|---|
| 2,665,772 | 1/1954 | Greer et al. | 134/103.1 X |
| 2,930,721 | 3/1960 | Tuthill | 134/95.1 X |
| 3,062,224 | 11/1962 | Skett et al. | 134/95.1 X |
| 3,140,828 | 7/1964 | Galanor | 134/103.1 X |
| 3,401,060 | 9/1968 | Watts | 134/102.1 X |
| 3,448,745 | 6/1969 | Seeley | 134/103.1 |
| 4,190,481 | 2/1980 | Goffredo | 134/103.2 X |
| 4,465,210 | 8/1984 | Iwanami . | |
| 4,606,476 | 8/1986 | Pocock et al. . | |

*Primary Examiner*—Philip R. Coe
*Attorney, Agent, or Firm*—Kenneth P. Glynn

[57] ABSTRACT

The present invention is directed to automatic, self-contained cleaning and sanitizing equipment. It includes a first liquid holding tank for a cleaning solution and a second liquid holding tank for a sanitizing solution. A cleaning line runs from the first tank and has an outlet adapted for connection to an item to be cleaned, and a cleaning return line runs back to the first tank and has an inlet adapted for connection to the item to be cleaned. A sanitizing line runs from the second tank and has an outlet connected directly to the item to be cleaned, or to the cleaning line so as to create a common connection to the item to be cleaned, and a sanitizing return line runs back to the second tank directly from the item to be cleaned, or from the cleaning return line so as to create a common connection running from the item to be cleaned. There is a first pump connected to the equipment for circulating liquid from the first tank to the item to be cleaned and back to the first tank through the cleaning return line and a second pump connected to the system for circulating liquid from the second tank to the item to be cleaned and back to the second tank through the sanitizing return line. An ozone generator is included on the second tank or the sanitizing line for inclusion of ozone therein and for creation of an ozone-based sanitization liquid therein.

20 Claims, 2 Drawing Sheets

CLEAN-IN-PLACE PROCESS AND EQUIPMENT

BACKGROUND OF THE INVENTION

1. Field of the Invention

The present invention is directed to process and equipment for clean-in-place use for cleaning and sanitizing items which generally have liquid stored and sometimes flow through them, e.g. commercial and retail water coolers, ice makers, coffee makers, ice cream and yogurt machines, milk dispensers, drink dispensers and the like. More specifically, the present invention involves clean-in-place capabilities for automatically cleaning and sanitizing such items.

2. Information Disclosure Statement

Water coolers, bulk milk dispensers and many other liquid holding/dispensing items have reservoirs, outlet lines, drains, etc. which require periodic cleaning and, preferably, sanitizing. Sometimes this is accomplished by complex permanent flushing apparatus and is otherwise frequently accomplished by the use of hard scrubbing and cleaning and/or hose or bucket flushing. However, these latter techniques and not very often followed or, if followed, are often inadequate.

For example, in a recent study of the reservoirs and dispensing faucets of ten conventional bottle water coolers at a Boston university over a two month period, between 2,000 and 1,000,000 bacteria per milliliter were found, even though the United States Federal Drug Administration maximum safe levels are 10,000 bacteria per milliliter. The problem is exacerbated by the companies that lease or sell such units because users are not properly warned of the bacteria problems nor are they usually given detailed cleaning instructions. When instructions are given, they usually require taking out the bottled water, preparing a diluted chlorine bleach solution, having the solution sit in the reservoirs for hours, removing the diluted bleach and rinsing until the chloride odor and taste are gone. Users simply won't follow such complex and time consuming steps.

Thus, the present invention is directed to portable equipment and the related process for cleaning and sanitizing items to be cleaned, wherein the portable equipment may be taken from item to item to be cleaned to permit clean-in-place operation without the need for movement of the item to a cleaning facility and without the need for permanently installed flushing equipment.

Further, the present invention uses unique combinations of equipment and steps to achieve the desired results. The prior art does not show any clean-in-place equipment of the type described herein. However, the following patents are believed to represent the current state of the art:

U.S. Pat. No. 4,606,476 issued to Richard Pocock et al. in 1986 describes a system for sanitizing beverage dispensing systems which utilizes a manifold with special fittings for sanitizing a system, including consumption of remaining beverage, sanitizing with a sanitizing liquid, flushing with water and drying with compressed gas.

U.S. Pat. No. 4,465,210 issued to Massao Iwanami in 1984 describes a circuit for washing a water-feeding system in automatic beverage dispensing machines. It describes a system for circulating cleaning solution through beverage vending machine lines using a return line which may be plugged and unplugged to and from the dispensing nozzles for cleaning and subsequent beverage dispensing. However, this is a permanent system and does not provide for portability of the equipment, nor does it provide for separate cleaning and sanitizing.

Thus, the prior art fails to teach or suggest the present invention system of attaching the apparatus to an item to be cleaned, first cleaning the item by automatic, controlled circulation of a cleaning solution, and subsequent automatic circulation of a sanitizing solution using on-site generated ozone for sanitization.

SUMMARY OF THE INVENTION

The present invention is directed to an automatic, self-contained cleaning and sanitizing equipment. It includes a first liquid holding tank for a cleaning solution and a second liquid holding tank for a sanitizing solution. There is a cleaning line running from the first liquid holding tank and having an outlet adapted for connection to an item to be cleaned, as well as a cleaning return line running back to the first liquid holding tank and having an inlet adapted for connection to an item to be cleaned. Also a sanitizing line runs from the second liquid holding tank and has an outlet adapted for connection to an item to be cleaned and a sanitizing return line runs back to the second liquid holding tank and has an inlet adapted for connection to an item to be cleaned. There is a first pumping means connected to the system for circulating liquid from the first holding tank to an item to be cleaned and back to the first liquid holding tank through the cleaning return line and a second pumping means connected to the system for circulating liquid from the second holding tank to an item to be cleaned and back to the second liquid holding tank through the sanitizing return line. Also an ozone generating means is included which is the second liquid holding tank or the sanitizing line for inclusion of ozone therein and for creation of an ozone-based sanitization liquid therein.

The present invention is also directed to a method of cleaning and sanitizing various items to be cleaned utilizing the present invention equipment.

BRIEF DESCRIPTION OF THE DRAWINGS

The present invention is more fully understood when the specification herein is taken in conjunction with the drawings appended hereto, wherein.

DETAILED DESCRIPTION OF THE PRESENT INVENTION

The present invention is automatic equipment for cleaning and sanitizing various items as described in the Field of The Invention above. By "cleaning" as used herein is meant the removal of build up of minerals, syrups, foreign debris and other minerals from reservoirs, lines, dispensing faucets and other components of items to be cleaned. The term "sanitizing" as used herein is meant the killing of bacteria. The term "item to be cleaned" as used herein is short for items to be cleaned and sanitized and includes items through which liquids flow, e.g. those which hold and dispense liquid materials.

By "cleaning solution" is meant any known cleaning solution appropriate for a particular application, i.e. which is recommended or affective for cleaning a particular item based on its materials of construction and the liquids normally passing therethrough. These include mild acid solutions and mild base solutions, and, in some instances, water, alcohol or the like. If is preferred in the present invention to use mild acid solutions such as citric acid for cleaning items such as water coolers.

By "solution for sanitizing" is meant any liquid carrier which will effectively carry ozone without substantially affecting the efficiency of the ozone. Water is preferred although non-aqueous carriers and aqueous solutions may be used without exceeding the scope of the invention.

Figure 1:
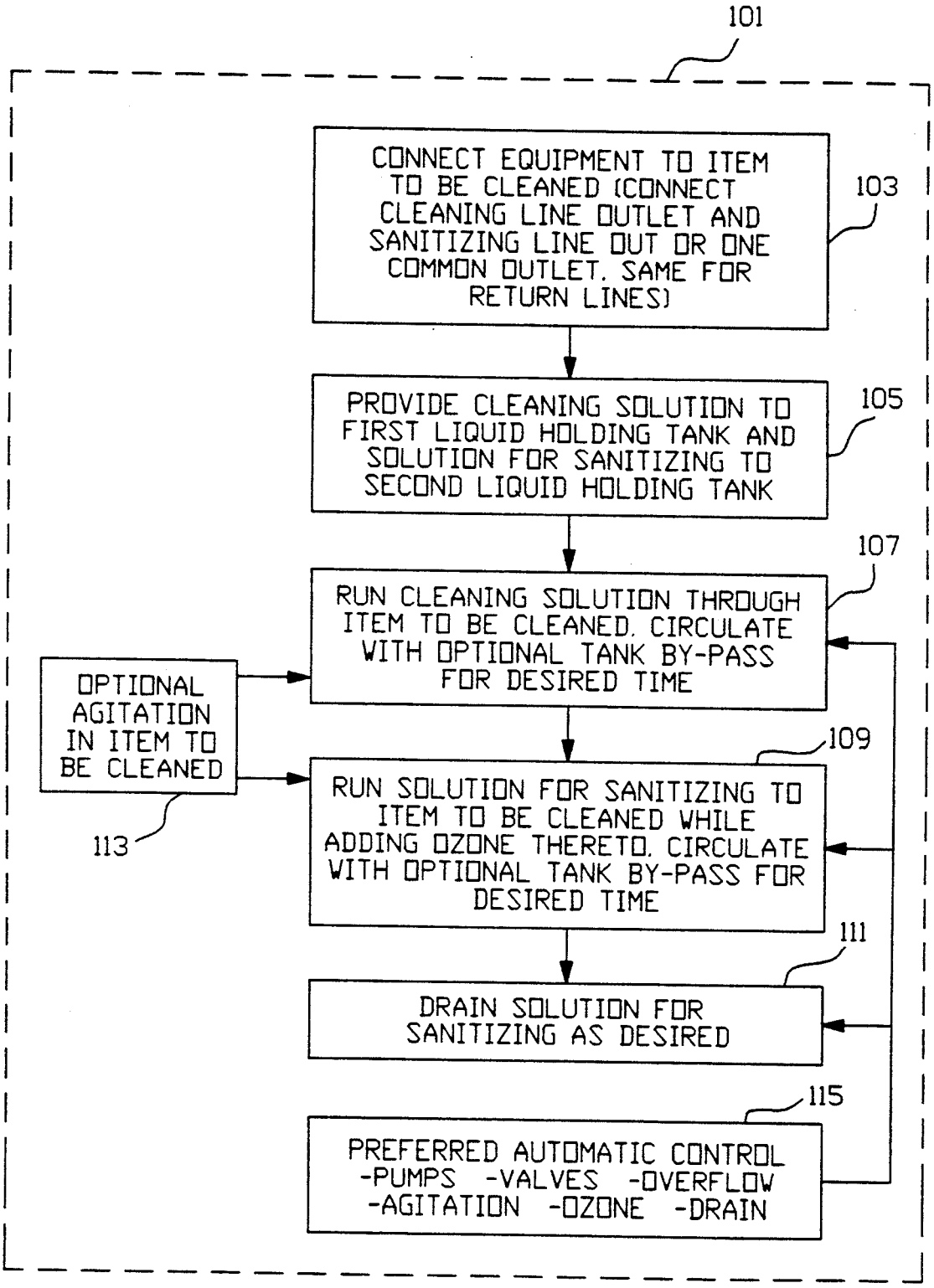
FIG. 1 shows a block diagram of the present invention process.

Referring now to FIG. 1, there is shown a block diagram 101 of the present invention process. The steps shown in FIG. 1 are shown sequentially. However, connection can occur before or after loading the solution, etc, but cleaning is to be performed before sanitizing. Block 103 shows connection to an item to be cleaned. This involves connection of a cleaning line outlet and of a sanitizing outlet to the item to be cleaned. A common outlet is preferred and connection may be accomplished by line to line connection, i.e. if the item to be cleaned has connectable lines, or by clamping or other attachment means, or as in the case of water cooler reservoirs, by use of a lid or top to straddle the reservoir to be cleaned. Return lines connected by screw fittings, rubber stretch tubing, funnel attachment or other fitting which will adapt to outlet, spigot or dispensing tube of the item to be cleaned.

Block 105 shows providing the appropriate fluids to a first liquid holding tank and a second liquid holding tank. These fluids are discussed above and below and the choice of cleaning fluid depends upon the item being cleaned.

Next, in block 107, the cleaning solution is run to the item to be cleaned and back and it is optionally agitated, (block 113) while in the item to be cleaned. The cleaning fluid may be pumped into the item to be cleaned, held there for a predetermined time and returned to the holding tank. It may be circulated without retention and may go through the holding tank or by-pass it. In those items to be cleaned where there is a significant volume of solution filling its volume, the holding tank is by-passed during circulation in preferred embodiments to hold down the total volume of solution needed and the tank size needed, as this is a portable system.

Next, in block 109, the solution for sanitizing is run while ozone is added thereto. Ozone may be first added, but its efficiency is lost as time passes and it is preferred and easier to inject ozone into solution as it is run to the item to be cleaned, e.g. ozone is injected into the sanitizing tank (second liquid holding tank or is preferably injected into the sanitizing line). Optional holding, by-passing and agitation is available based on the considerations discussed immediately above in conjunction with cleaning. The ozone is generated on site and equipment for this purpose is an integral aspect of the process.

The sanitizing solution may be drained as desired, block 111, at site, and the cleaning solution will be disposed of as required by governing laws and standards.

Block 115 shows optional but preferred automatic control for pumps, for opening and closing valves to control solution sequence, flow, by-pass, etc., overflow control (shut off if overflow at the item to be cleaned is detected), ozone generation and drain. These aspects are further developed in conjunction with the following FIG. 2 discussion of a preferred present invention equipment arrangement.

Figure 2:
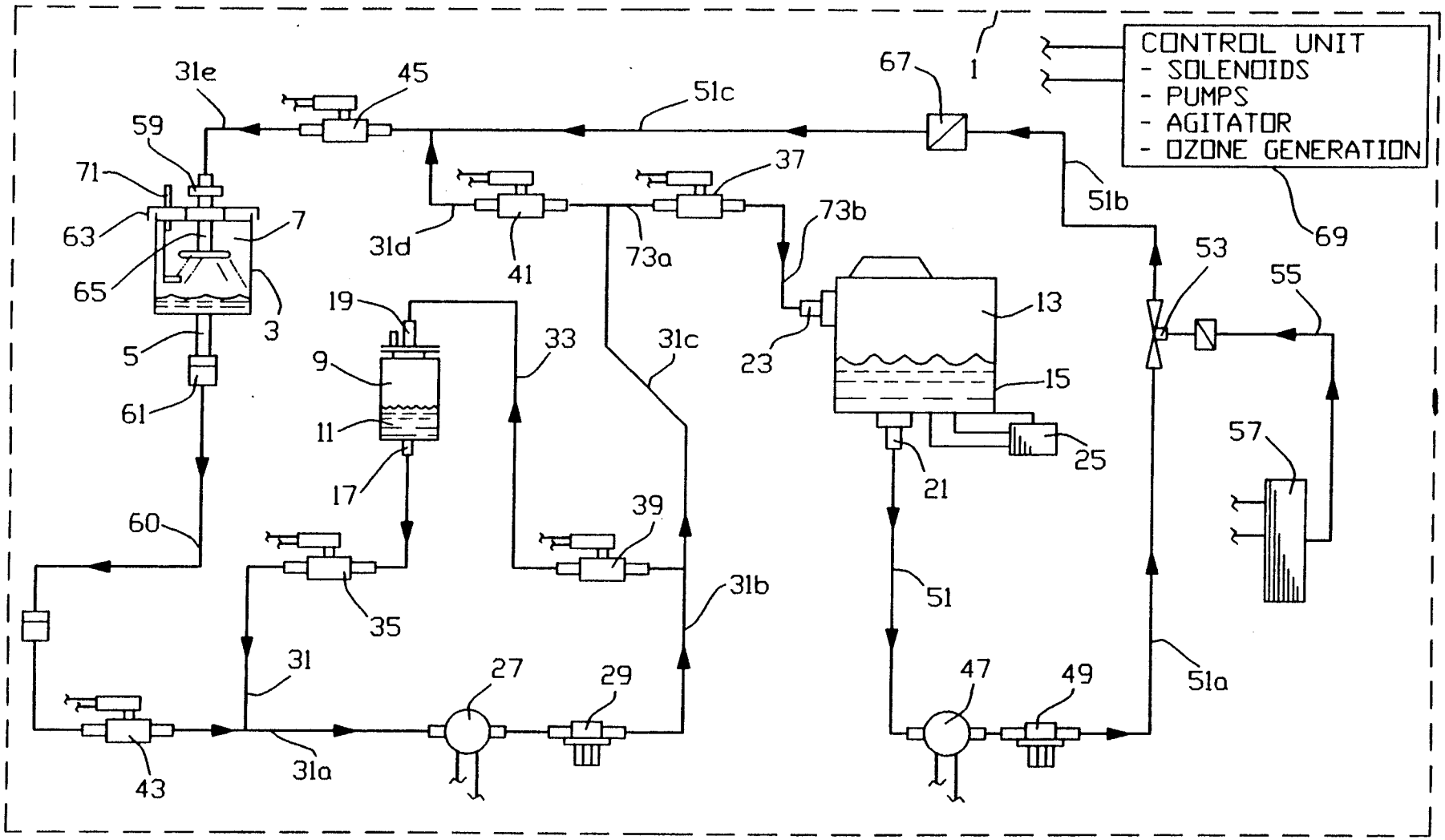
FIG. 2 illustrates a schematic flow diagram of preferred present invention equipment.

FIG. 2 shows a flow diagram of present invention equipment which is a preferred embodiment adapted for cleaning items such as a water cooler, yogurt machine, etc. Thus, reference will be made to a water cooler, it being understood here to include other types of items to be cleaned.

Equipment 1 is shown generally by the dotted line block. Water cooler reservoir 3 and water cooler outlet 5 are of a water cooler (not shown in full detail), the item to be cleaned. Water cooler reservoir 3 has an open top 7, as is the case when a bottle of water has been removed. Lid 63 is part of present invention equipment 1 and is placed on top 7 of reservoir 3. Lid 63 includes a quick connect for attachment to a common cleaning line/sanitizing line outlet 59. Common return line 60 has an inlet 61 which is a quick connect attached to water cooler outlet 5.

There is included a first liquid holding tank 9 for holding a cleaning solution 9, e.g. citric acid (aqueous, diluted). There is also a second liquid holding tank 13 for holding a solution for sanitizing 15, e.g. water. First liquid holding tank outlet 17 runs to a cleaning line, dedicated section 31 (dedicated in that it is not also used for by-passing or as a return line). This continues as cleaning line sections 31*a*, 31*b*, 31*c*, 31*d* and 31*e*, as shown, each section being lettered sequentially to show cleaning solution running to reservoir 3, but being differentiated because of other functions described further below, this cleaning line being also connected to pump 27 and strainer 29, as well as valve/solenoids 35, 41 and 45 sequentially as the cleaning solution initially flows.

Cleaning return line includes common return line 60, valve/solenoid 43 line section 31*a*, pump 27, strainer 29, line section 31*b*, valve/solenoid 39 and return line section 33, connected to tank inlet 19.

By-passing involves utilizing common return line 60, valve/solenoid 43, line section 31*a*, pump 27, strainer 29, line section 31*b*, line section 31*c*, valve/solenoid 41, line section 31*d*, valve/solenoid 45 and line section 31*e*.

Second liquid hold tank provides the solution for sanitizing 15 via tank outlet 21 through sanitizing line section 51, pump 47, strainer 49 line section 51*a* to ozone injector 53, line section 51*b*, check valve 67, line section 51*c*, valve/solenoid 45, and line section 31*e*.

Sanitizing return line includes common return line 60, valve/solenoid 43, line section 31*a*, pump 27 (which may be pumping to make the transition with pump 47), strainer 29, line sections 31*b* and 31*c*, sanitizing return line section 73*a*, valve/solenoid 37, line section 73*b* and tank inlet 23. Drain 25 may be used as desired when the process is otherwise completed.

Ozone converter 57 takes oxygen and converts it to ozone. The ozone goes through injector 53 to the solution for sanitizing via ozone line 55. Control unit 69 operates to control the various operations by controlling the valve/solenoids, pumps, ozone, etc. as described below. Check valve 67 is used to prevent backflow. Sprayer/agitator 65 sprays and agitates the solutions to enhance their effectiveness. Level control overflow detector 71 extends from lid 63 into reservoir 3 and shuts off pumping and/or closes valves when it detects liquid above a preset level to prevent overflow. Optional second liquid holding tank by-pass is not shown in this embodiment.

The equipment 1 is operated as follows:

After the equipment 1 has been properly attached to cooler reservoir 3, the control unit 69 is manually operated or programmed to open solenoid valve 35, solenoid valve 41 and solenoid valve 45, with all other solenoid valves closed. Pump 27 is started and this pumps cleaning solution 11 from holding tank 9 into reservoir 3. Next, solenoid valve 43 opens and solenoid valve 35 closes. This places the system in the recirculating mode while by-passing tank 9 and operation may continue in this mode as desired, e.g., for 7 to 10 minutes. To return or capture the used cleaning solution, solenoid valve 41 is closed and solenoid valve 39 is opened.

Once the spent cleaning solution is recharged to tank 9, solenoid 39 is closed and solenoid 37 opens. Pump 47 starts and sanitizing solution 15 is cycled as shown. Ozone converter 57 and ozone injector 53 add ozone to the circulating water and this process continues as the sanitizing solution with ozone circulates for a predetermined period of time, for example, 15 to 20 minutes.

Pump 47 may be stopped while pump 27 will run for a short period of time, e.g., 15 to 30 seconds to return the solution 15 to tank 13.

The pumps and other equipment may operate with a normal "house current" such is 115 volts and it is desirable to utilize and outlet with a ground fault circuit interrupter or to include a ground fault circuit interrupters as part of the present invention equipment.

Obviously, numerous modifications and variations of the present invention are possible in light of the above teachings. It is therefore understood that within the scope of the appended claims, the invention may be practiced otherwise than as specifically described herein.

What is claimed is:

1. Automatic, self contained cleaning and sanitizing equipment, which comprises:

(a) a first liquid holding tank for a cleaning solution;

(b) a second liquid holding tank for a sanitizing solution;

(c) a cleaning line running from said first liquid holding tank and having an outlet adapted for connection to an item to be cleaned;

(d) a cleaning return line running back to said first liquid holding tank and having an inlet adapted for connection to said item to be cleaned;

(e) a sanitizing line running from said second liquid holding tank and having an outlet connected to said cleaning line which is adapted for connection to said item to be cleaned;

(f) a sanitizing return line running back to said second liquid holding tank and having an inlet connected to said cleaning return line, which cleaning return line is adapted for connection to said item to be cleaned;

(g) a first pumping means connected to said equipment for circulating liquid from said first holding tank to said item to be cleaned and back to said first liquid holding tank through said cleaning return line;

(h) a second pumping means connected to said equipment for circulating liquid from said second holding tank to said item to be cleaned and back to said second liquid holding tank through said sanitizing return line;

(i) an ozone generating means connected to said second liquid holding tank or said sanitizing line for inclusion of ozone therein and for creation of an ozone-based sanitization liquid therein.

2. The cleaning and sanitizing equipment of claim 1, which further compromises an automatic control means connected to said equipment for operating said first pumping means and said second pumping means in sequential order and for predetermined periods of time.

3. The cleaning and sanitizing equipment of claim 1 further including a by-pass line connecting from said cleaning return line to said cleaning line to permit by-passing said first liquid holding tank during circulation of a cleaning liquid, as desired, and to permit by-passing said second liquid holding tank during circulation of a sanitizing solution, as desired.

4. The cleaning and sanitizing equipment of claim 1 further including spray means at said cleaning line outlet.

5. The cleaning and sanitizing equipment of claim 1 which further comprises an automatic control means including a plurality of valves connected to said lines, said automatic control means being connected to said system for operating said first pumping means and said second pumping means and said plurality of valves for opening and closing said cleaning line, cleaning return line, sanitizing line and sanitizing return line in sequential order and for predetermined periods of time.

6. The cleaning and sanitizing equipment of claim 5 further including spray means at said cleaning line outlet.

7. The cleaning and sanitizing equipment of claim 5 which further includes an automatic control means for starting and stopping said ozone generating means.

8. The cleaning and sanitizing equipment of claim 5 wherein said ozone generating means includes an ozone converter and an ozone injector.

9. The cleaning and sanitizing equipment of claim 1 which further includes an automatic control means for starting and stopping said ozone generating means.

10. The cleaning and sanitizing equipment of claim 1 wherein said ozone generating means includes an ozone converter and an ozone injector.

11. Automatic, self contained cleaning and sanitizing equipment, which compromises:

(a) a first liquid holding tank for a cleaning solution;

(b) a second liquid holding tank for a sanitizing solution;

(c) a cleaning line running from said first liquid holding tank and having an outlet adapted for direct connection to an item to be cleaned;

(d) a cleaning return line running back to said first liquid holding tank and having an inlet adapted for direct connection to said item to be cleaned;

(e) a sanitizing line running from said second liquid holding tank and having an outlet adapted for direct connection to said item to be cleaned;

(f) a sanitizing return line running back to said second liquid holding tank and having an inlet adapted for direct connection to said item to be cleaned;

(g) a first pumping means connected to said equipment for circulating liquid from said first holding tank to said item to be cleaned and back to said first liquid holding tank through said cleaning return line;

(h) a second pumping means connected to said equipment for circulating liquid from said second holding tank to said item to be cleaned and back to said second liquid holding tank through said sanitizing return line;

(i) an ozone generating means connected to said second liquid holding tank or said sanitizing line for inclusion of ozone therein and for creation of an ozone-based sanitization liquid therein.

12. The cleaning and sanitizing equipment of claim 11, which further compromises an automatic control means connected to said equipment for operating said first pumping means and said second pumping means in sequential order and for predetermined periods of time.

13. The cleaning and sanitizing equipment of claim 11 further including a by-pass line connecting from said cleaning return line to said cleaning line to permit by-passing said first liquid holding tank during circulation of a cleaning liquid, as desired, and to permit by-passing said second liquid holding tank during circulation of a sanitizing solution, as desired.

14. The cleaning and sanitizing equipment of claim 11 further including spray means at said cleaning line outlet.

15. The cleaning and sanitizing equipment of claim 11 which further comprises an automatic control means including a plurality of valves connected to said lines, said automatic control means being connected to said system for operating said first pumping means and said second pumping means and said plurality of valves for opening and closing said cleaning line, cleaning return line, sanitizing line and sanitizing return line in sequential order and for predetermined periods of time.

16. The cleaning and sanitizing equipment of claim 15 further including spray means at said cleaning line outlet.

17. The cleaning and sanitizing equipment of claim 11 which further includes an automatic control means for starting and stopping said ozone generating means.

18. The cleaning and sanitizing equipment of claim 15 wherein said ozone generating means includes an ozone converter and an ozone injector.

19. The cleaning and sanitizing equipment of claim 15 which further includes an automatic control means for starting and stopping said ozone generating means.

20. The cleaning and sanitizing equipment of claim 11 wherein said ozone generating means includes an ozone converter and an ozone injector.

* * * * *